US005225099A

United States Patent [19]

Basu et al.

[11] Patent Number: 5,225,099

[45] Date of Patent: Jul. 6, 1993

[54] AZEOTROPE-LIKE COMPOSITIONS OF 4-TRIFLUOROMETHYL-1,1,1,2,2,3,3,5,5,5-DECAFLUOROPENTANE

[75] Inventors: Rajat S. Basu, Williamsville; Richard M. Hollister; Kane D. Cook, both of Buffalo; Michael Van Der Puy, Cheektowaga, all of N.Y.

[73] Assignee: Allied-Signal Inc., Morristownship, Morris County, N.J.

[21] Appl. No.: 851,449

[22] Filed: Mar. 16, 1992

[51] Int. Cl.[5] ..... C11D 7/30; C11D 7/50; C23G 5/028; B08B 3/00

[52] U.S. Cl. ..... 252/171; 134/12; 134/31; 134/38; 134/39; 134/40; 134/42; 252/153; 252/162; 252/170; 252/172; 252/364; 252/DIG. 9

[58] Field of Search ..... 252/153, 162, 170, 171, 252/172, 364, DIG. 9; 134/31, 38, 39, 40, 42, 12

[56] References Cited

U.S. PATENT DOCUMENTS

| | | | |
|---|---|---|---|
| 5,059,728 | 10/1991 | Li et al. | 570/134 |
| 5,073,288 | 12/1991 | Anton | 252/162 |
| 5,073,290 | 12/1991 | Anton et al. | 252/162 |
| 5,076,956 | 12/1991 | Anton | 252/162 |
| 5,087,777 | 2/1992 | Li et al. | 570/136 |
| 5,118,359 | 6/1992 | Li et al. | 134/42 |
| 5,118,360 | 6/1992 | Li et al. | 134/42 |

FOREIGN PATENT DOCUMENTS

| | | |
|---|---|---|
| 431458 | 6/1991 | European Pat. Off. . |
| 3-252500 | 11/1991 | Japan . |

OTHER PUBLICATIONS

Chemical Abstract No. 88(5):37340d abstract of Yanagida et al "Reaction of hexafluoropropene oligomers with carboxylate anions" *Tetrahedron* Lett. (27) pp. 2337–2340 1977.

Chemical Abstract No. 106(5):32306c abstract of Snegireu et al "Reaction of perfluoro-2-methyl-2-pentene with o-nucleophile", *Izr Akad Nauk SSSR, Ser. Khim.*, (1) pp. 106–119 1986.

*Primary Examiner*—Linda D. Skaling

*Attorney, Agent, or Firm*—M. L. Brown; J. P. Friedenson; D. L. Webster

[57] ABSTRACT

Azeotrope-like compositions comprising 4-trifluoromethyl-1,1,1,2,2,3,3,5,5,5-decafluoropentane and a second component selected from the group consisting of methanol; ethanol; 1-propanol; 2-propanol; 2-methyl-2-propanol; 2-methyl-2-butanol; n-hexane; isohexane; 2-propanone; and 2-butanone and optionally nitromethane are stable and have utility as degreasing agents and as solvents in a variety of industrial cleaning applications including cold cleaning and defluxing of printed circuit boards and dry cleaning.

20 Claims, No Drawings

AZEOTROPE-LIKE COMPOSITIONS OF 4-TRIFLUOROMETHYL-1,1,1,2,2,3,3,5,5,5-DECAFLUOROPENTANE

FIELD OF THE INVENTION

This invention relates to azeotrope-like mixtures of 4-trifluoromethyl 1,1,1,2,2,3,3,5,5,5-decafluoropentane. These mixtures are useful in a variety of vapor degreasing, cold cleaning and solvent cleaning applications including defluxing and dry cleaning.

BACKGROUND OF THE INVENTION

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing a room temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al. in U.S. Pat. No. 3,085,918 disclose such suitable vapor degreasers comprising a boiling sump, a clean sump, a water separator, and other ancillary equipment.

Cold cleaning is another application where a number of solvents are used. In most cold cleaning applications, the soiled part is either immersed in the fluid or wiped with rags or similar objects soaked in solvents and allowed to air dry.

Fluorocarbon solvents, such as trichlorotrifluoroethane, have attained widespread use in recent years as effective, nontoxic, and nonflammable agents useful in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts and the like.

Azeotropic or azeotrope-like compositions are desired because they do not fractionate upon boiling. This behavior is desirable because in the previously described vapor degreasing equipment with which these solvents are employed, redistilled material is generated for final rinse-cleaning. Thus, the vapor degreasing system acts as a still. Unless the solvent composition exhibits a constant boiling point, i.e., is azeotrope-like, fractionation will occur and undesirable solvent distribution may act to upset the cleaning and safety of processing. Preferential evaporation of the more volatile components of the solvent mixtures, which would be the case if they were not azeotrope-like, would result in mixtures with changed compositions which may have less desirable properties, such as lower solvency towards soils, less inertness towards metal, plastic or elastomer components, and increased flammability and toxicity. The art has looked towards azeotrope or azeotrope-like compositions including the desired fluorocarbon components such as trichlorotrifluoroethane which include components which contribute additionally desired characteristics, such as polar functionality, increased solvency power, and stabilizers.

The art is continually seeking new fluorocarbon, hydrofluorocarbon, and hydrochlorofluorocarbon based azeotrope-like mixtures which offer alternatives for new and special applications for vapor degreasing and other cleaning applications. Currently, of particular interest, are fluorocarbon, hydrofluorocarbon, and hydrochlorofluorocarbon based azeotrope-like mixtures with minimal or no chlorine which are considered to be stratospherically safe substitutes for presently used chlorofluorocarbons (CFCs). The latter are suspected of causing environmental problems in connection with the earth's protective ozone layer. Mathematical models have substantiated that hydrofluorocarbons, such as 4-trifluoromethyl 1,1,1,2,2,3,3,5,5,5-decafluoropentane (known in the art as HFC-52-13), will not adversely affect atmospheric chemistry, being negligible contributors to ozone depletion and to green-house global warming in comparison to chlorofluorocarbons such as 1,1,2-trichloro-1,2,2-trifluoroethane (CFC-113).

U.S. Pat. Nos. 5,073,288; 5,073,290; and 5,076,956 teach binary and ternary azeotrope like compositions having 1,1,1,2,2,3,5,5,5-nonafluoro-4 trifluoromethylpentane and/or 1,1,1,2,2,5,5,5 octafluoro-4-trifluoromethylpentane therein.

DETAILED DESCRIPTION OF THE INVENTION

Our solution to the need in the art for substitutes for chlorofluorocarbon solvents is mixtures comprising 4-trifluoromethyl-1,1,1,2,2,3,3,5,5,5 decafluoropentane and a second component selected from the group consisting of methanol; ethanol; 1-propanol; 2-propanol; 2-methyl 2-propanol; 2-methyl 2-butanol; n-hexane; isohexane; 2-propanone; and 2-butanone optionally nitromethane. Also, novel azeotrope-like or constant boiling compositions have been discovered comprising 4-trifluoromethyl-1,1,1,2,2,3,3,5,5,5 decafluoropentane and a second component selected from the group consisting of methanol; ethanol; 1.propanol; 2-propanol; 2-methyl 2-propanol; 2-methyl 2 butanol; n-hexane; isohexane; 2-propanone; and 2 butanone optionally nitromethane.

Preferably, the novel azeotrope-like compositions comprise effective amounts of 4-trifluoromethyl 1,1,1,2,2,3,3,5,5,5-decafluoropentane and the second component selected from the group consisting of methanol; ethanol; 1-propanol; 2-propanol; 2-methyl-2-propanol; 2-methyl-2-butanol; n-hexane; isohexane; 2-propanone; and 2-butanone. The term "effective amounts" as used herein means the amount of each component which upon combination with the other component, results in the formation of the present azeotrope-like compositions.

The azeotrope-like compositions comprise from about 15 to about 99.99 weight percent of 4-trifluoromethyl-1,1,1,2,2,3,3,5,5,5-decafluoropentane and from about 0.01 to about 85 of a second component selected from the group consisting of methanol; ethanol; 1-propanol; 2-propanol; 2-methyl 2-propanol; 2-methyl-2-butanol; n-hexane; isohexane; 2-propanone; and 2-butanone; and from 0 to about 1 weight percent nitromethane.

The present azeotrope-like compositions are advantageous for the following reasons. The 4-trifluoromethyl-1,1,1,2,2,3,3,5,5,5-decafluoropentane component is a negligible contributor to ozone depletion. The methanol; ethanol; 1-propanol; 2-propanol; 2-methyl-2-propanol; 2-methyl-2-butanol; n-hexane; isohexane; 2-propanone; and 2-butanone components have good solvent properties. Thus, when The preferred n-hexane based azeotrope-like compositions are in Table VII below where 4-trifluoromethyl-1,1,1,2,2,3,3,5,5,5-decafluoropentane is abbreviated as HFC-52 13:

TABLE I

| | PRE-FERRED RANGE (WT. %) | MORE PRE-FERRED RANGE (WT. %) | MOST PRE-FERRED RANGE (WT. %) | BOILING POINT (°C.) (760 mmHg) |
|---|---|---|---|---|
| HFC-52-13 | 47.8-95.2 | 54.5-91.5 | 59.6-90.5 | 51 ± 1 |
| Methanol | 4.8-52.2 | 8.5-45.5 | 9.5-40.4 | |
| Nitromethane | 0-1 | 0-0.5 | 0-0.4 | |

The preferred ethanol based azeotrope-like compositions are in Table II below where 4-trifluoromethyl-1,1,1,2,2,3,3,5,5,5-decafluoropentane is abbreviated as HFC-52-13:

TABLE II

| COM-PONENTS | PRE-FERRED RANGE (WT. %) | MORE PRE-FERRED RANGE (WT. %) | MOST PRE-FERRED RANGE (WT. %) | BOILING POINT (°C.) (760 mmHg) |
|---|---|---|---|---|
| HFC-52-13 | 54-96.2 | 64.5-92.1 | 67.6-91.5 | 54.9 ± 0.6 |
| Methanol | 3.8-46 | 7.9-35.5 | 8.5-32.4 | |
| Nitromethane | 0-1 | 0-0.5 | 0-0.4 | |

The preferred 1-propanol based azeotrope-like compositions are in Table III below where 4-trifluoromethyl-1,1,1,2,2,3,3,5,5,5-decafluoropentane is abbreviated as HFC-52-13:

TABLE III

| COM-PONENTS | PRE-FERRED RANGE (WT. %) | MORE PRE-FERRED RANGE (WT. %) | MOST PRE-FERRED RANGE (WT. %) | BOILING POINT (°C.) (760 mmHg) |
|---|---|---|---|---|
| HFC-52-13 | 75-99.5 | 80-99.95 | 82-99.95 | 57.7 ± 1 |
| 1-Propanol | 0.05-25 | 0.05-20 | 0.05-18 | |
| Nitromethane | 0-1 | 0-0.5 | 0-0.3 | |

The preferred 2-propanol based azeotrope-like compositions are in Table IV below where 4-trifluoromethyl-1,1,1,2,2,3,3,5,5,5-decafluoropentane is abbreviated as HFC-52-13:

TABLE IV

| COM-PONENTS | PRE-FERRED RANGE (WT. %) | MORE PRE-FERRED RANGE (WT. %) | MOST PRE-FERRED RANGE (WT. %) | BOILING POINT (°C.) (760 mmHg) |
|---|---|---|---|---|
| HFC-52-13 | 54-97 | 57.5-96 | 61.6-95 | 57.7 ± 0.6 |
| 2-Propanol | 3-46 | 4-42.5 | 5-38.4 | |
| Nitromethane | 0-1 | 0-0.5 | 0-0.4 | |

The preferred 2-methyl-2-propanol based azeotrope-like compositions are in Table V below where 4-trifluoromethyl-1,1,1,2,2,3,3,5,5,5-decafluoropentane is abbreviated as HFC-52-13:

TABLE V

| COM-PONENTS | PRE-FERRED RANGE (WT. %) | MORE PRE-FERRED RANGE (WT. %) | MOST PRE-FERRED RANGE (WT. %) | BOILING POINT (°C.) (760 mmHg) |
|---|---|---|---|---|
| HFC-52-13 | 69-98.6 | 74.5-96.5 | 76.6-96 | 60.1 ± 0.6 |
| 2-Methyl-2-Propanol | 1.4-31 | 3.5-25.5 | 4-23.4 | |
| Nitromethane | 0-1 | 0-0.5 | 0-0.4 | |

The preferred 2-methyl-2butanol based azeotrope-like compositions are in Table VI below where 4-trifluoromethyl-1,1,1,2,2,3,3,5,5,5-decafluoropentane is abbreviated as HFC-52-13:

TABLE VI

| COM-PONENTS | PRE-FERRED RANGE (WT. %) | MORE PRE-FERRED RANGE (WT. %) | MOST PRE-FERRED RANGE (WT. %) | BOILING POINT (°C.) (760 mmHg) |
|---|---|---|---|---|
| HFC-52-13 | 94-99.99 | 95.5-99.95 | 96.2-99.95 | 61.5 ± 0.6 |
| 2-Methyl-2-butanol | 0.01-6 | 0.05-4.5 | 0.05-3.8 | |
| Nitromethane | 0-1 | 0-0.5 | 0-0.3 | |

The preferred n-hexane based azeotrope-like compositions are in Table VII below where 4-trifluoromethyl--1,1,1,2,2,3,3,5,5,5-decafluoropentane is abbreviated as HFC-52-13:

TABLE VII

| COM-PONENTS | PRE-FERRED RANGE (WT. %) | MORE PRE-FERRED RANGE (WT. %) | MOST PRE-FERRED RANGE (WT. %) | BOILING POINT (°C.) (760 mmHg) |
|---|---|---|---|---|
| HFC-52-13 | 59-93 | 64.6-90 | 66.7-88 | 51 ± 0.6 |
| N-hexane | 7-41 | 10-35.4 | 12-33.3 | |
| Nitromethane | 0-1 | 0-0.4 | 0-0.3 | |

Commercial grade isohexane comprises about 35 to about 75 weight percent 2-methylpentane, about 10 to about 40 weight percent 3 -methylpentane, about 7 to about 30 weight percent 2,3- dimethylbutane, about 7 to about 30 weight percent 2,2-dimethylbutane, and about 0.1 to about 10 weight percent n-hexane. The preferred commercial grade isohexane based azeotrope-like compositions are in Table VIII below where 4 -trifluoromethyl-1,1,1,2,2,3,3,5,5,5-decafluoropentane is abbreviated as HFC-52-13:

TABLE VIII

| COMPONENTS | PREFERRED RANGE (WT. %) | MORE PREFERRED RANGE (WT. %) | MOST PREFERRED RANGE (WT. %) | BOILING POINT (°C.) (760 mmHg) |
|---|---|---|---|---|
| HFC-52-13 | 24–75 | 39.5–70 | 39.7–67 | 46.09 ± 1 |
| Commercial Grade Isohexane | 25–76 | 30–60.5 | 33–60.3 | |
| Nitromethane | 0–1 | 0–0.5 | 0–0.3 | |

The preferred 2-propanone based azeotrope-like compositions are in Table IX below where 4-trifluoromethyl-1,1,1,2,2,3,3,5,5,5-decafluoropentane is abbreviated as HFC-52-13:

TABLE IX

| COMPONENTS | PREFERRED RANGE (WT. %) | MORE PREFERRED RANGE (WT. %) | MOST PREFERRED RANGE (WT. %) | BOILING POINT (°C.) (760 mmHg) |
|---|---|---|---|---|
| HFC-52-13 | 59–80 | 18–65 | 20–70 | 53.8 ± 1 |
| 2-Propanone | 5–85 | 35–82 | 30–80 | |
| Nitromethane | 0–1 | 0–0.5 | 0–0.4 | |

The preferred 2-butanone based azeotrope-like compositions are in Table X below where 4-trifluoromethyl-1,1,1,2,2,3,3,5,5,5-decafluoropentane is abbreviated as HFC-52-13:

TABLE X

| COMPONENTS | PREFERRED RANGE (WT. %) | MORE PREFERRED RANGE (WT. %) | MOST PREFERRED RANGE (WT. %) | BOILING POINT (°C.) (760 mmHg) |
|---|---|---|---|---|
| HFC-52-13 | 59–95 | 61.5–92.5 | 64.6–90 | 59.2 ± 1 |
| 2-Butanone | 5–41 | 7.5–38.5 | 10–35.4 | |
| Nitromethane | 0–1 | 0–0.5 | 0–0.4 | |

All compositions within the indicated ranges, as well as certain compositions outside the indicated ranges, are azeotrope-like, as defined more particularly below.

The precise azeotrope compositions have not been determined but have been ascertained to be within the above ranges. Regardless of where the true azeotropes lie, all compositions with the indicated ranges, as well as certain compositions outside the indicated ranges, are azeotrope-like, as defined more particularly below.

The term "azeotrope-like composition" as used herein is intended to mean that the composition behaves like an azeotrope, i.e. has constant-boiling characteristics or a tendency not to fractionate upon boiling or evaporation. Thus, in such compositions, the composition of the vapor formed during boiling or evaporation is identical or substantially identical to the original liquid composition. Hence, during boiling or evaporation, the liquid composition, if it changes at all, changes only to a minimal or negligible extent. This is to be contrasted with non azeotrope-like compositions in which during boiling or evaporation, the liquid composition changes to a substantial degree. As is readily understood by persons skilled in the art, the boiling point of the azeotrope-like composition will vary with the pressure.

The azeotrope-like compositions of the invention are useful as solvents in a variety of vapor degreasing, cold cleaning and solvent cleaning applications including defluxing and dry cleaning.

In one process embodiment of the invention, the azeotrope-like compositions of the invention may be used to dissolve contaminants or remove contaminants from the surface of a substrate by treating the surfaces with the compositions in any manner well known to the art such as by dipping or spraying or use of conventional degreasing apparatus wherein the contaminants are substantially removed or dissolved.

The 4-trifluoromethyl 1,1,1,2,2,3,3,5,5,5-decafluoropentane of the present invention may be prepared by adaptation of a known method. The methanol; ethanol; 1-propanol; 2-propanol; 2-methyl 2-propanol; 2-methyl 2-butanol; n-hexane; isohexane; 2-propanone; 2-butanone; and nitromethane components of the novel solvent azeotrope-like compositions of the invention are known materials and are commercially available. Commercial grade isohexane is a mixture of the following isomers in weight percent: about 48% 2-methylpentane; about 19% 3-methylpentane; about 17% 2,3-dimethylbutane; about 12% 2,2-dimethylbutane; about 3% n-hexane; and less than about 1% other isomers.

The present invention is more fully illustrated by the following non limiting Examples.

EXAMPLE 1

This Example is directed to the preparation of 4-trifluoromethyl-1,1,1,2,2,3,3,5,5,5-decafluoropentane.

The thermodynamic dimer of commercially available hexafluoropropylene ($(CF_3)_2C{=}CFCF_2CF_3$) was prepared by the method described in "F-2-Methyl-2-Pentanol. An Easily Prepared Perfluorinated Tertiary Alcohol", J. Org. Chem. 46. 2379 (1981). A mixture of 75 milliliters triethylene glycol dimethyl ether, 689 grams crude hexafluoropropylene dimer (from the isomerization, kinetic dimer <1%, along with 16% hexafluoropropylene trimers) was cooled to 10° C. Ammonium bifluoride (160 grams) was added over 0.5 hour (maximum temperature 33° C.) and stirred for an additional 2.5 hours thereafter. The slurry was suction filtered to give 735 grams of a homogeneous liquid phase. Distillation (3 foot (91 centimeters) packed column) at 747 mm Hg (98 kPa) gave 57 grams forerun (to 61° C.) and 286 grams of the desired 4-trifluoromethyl-1,1,1,2,2,3,3,5,5,5-decafluoropentane, boiling point of 61–62° C. (97% GC purity).

EXAMPLE 2

This example shows that a minimum in the boiling point versus composition curve occurs in the region of 70 weight percent 4-trifluoromethyl 1,1,1,2,2,3,3,5,5,5 decafluoropentane(hereinafter HFC-52-13) and 30 weight percent methanol indicating that an azeotrope forms in the neighborhood of this composition.

A microebulliometer which consisted of a 15 milliliter round bottom double neck flask containing a magnetic stirbar and heated with an electrical heating mantel was used. Approximately 2.5 milliliters of the lower boiling material, HFC-52-13, prepared according to Example 1 above, was charged into the microebulliometer and methanol was added in small measured increments by an automated syringe capable of injecting microliters. The temperature was measured using a platinum resistance thermometer and barometric pressure was measured. An approximate correction to the boiling point was done to obtain the boiling point at 760 mm Hg.

The boiling point was measured and corrected to 760 mm Hg (101 kPa) for various mixtures of HFC-52-13 and methanol. Interpolation of the data shows that a minimum boiling point occurs in the region of about 9.5 to about 38 weight percent methanol. The best estimate of the position of the minimum is 30 weight percent methanol, although the mixtures are constant-boiling, to within 1° C., in the region of 3 to 45 weight percent methanol. A minimum boiling azeotrope is thus shown to exist in this composition range.

From the above example, it is readily apparent that additional constant-boiling or essentially constant-boiling mixtures of the same components can readily be identified by anyone of ordinary skill in this art by the method described. No attempt was made to fully characterize and define the outer limits of the composition ranges which are constant-boiling. Anyone skilled in the art can readily ascertain other constant boiling or essentially constant-boiling mixtures containing the same components.

EXAMPLE 3

Example 2 was repeated except that ethanol was used instead of methanol. Approximately 2.8 milliliters of the lower boiling material, HFC.52 13, prepared according to Example 1 above, were initially charged into the microebulliometer and ethanol was added in small measured increments by an automated syringe capable of injecting microliters. The boiling point was measured and corrected to 760 mm Hg (101 kPa), for various mixtures of HFC-52-13 and ethanol. Interpolation of these data shows that a minimum boiling point occurs in the region of about 8.5 to about 32 weight percent ethanol. The best estimate of the position of the minimum is 25.57 weight percent ethanol, although the mixtures are constant boiling, to within 0.6° C., in the region of 3.8 to 45 weight percent ethanol. A minimum boiling azeotrope is thus shown to exist in this composition range.

EXAMPLE 4

Example 2 was repeated except that 1-propanol was used instead of methanol. 2.5 milliliters of HFC-52-13, prepared according to Example 1 above, were initially charged to the ebulliometer. The boiling point was measured and corrected to 760 mm Hg (101 kPa), for various mixtures of HFC-52-13 and 1-propanol. Interpolation of these data shows that a minimum boiling point occurs in the region of about 0.5 to about 18 weight percent 1-propanol. The best estimate of the position of the minimum is 6 weight percent 1 propanol, although the mixtures are constant-boiling, to within 1° C., in the region of 0.05 to 25 weight percent 1-propanol. A minimum boiling azeotrope is thus shown to exist in this composition range

EXAMPLE 5

Example 2 was repeated except that 2-propanol was used instead of methanol. 2.5 milliliters of HFC-52-13, prepared according to Example 1 above, were initially charged to the ebulliometer. The boiling point was measured and corrected to 760 mm Hg (101 kPa), for various mixtures of HFC-52-13 and 2-propanol. Interpolation of these data shows that a minimum boiling point occurs in the region of about 5 to about weight percent 2-propanol. The best estimate of the position of the minimum is 26.2 weight percent 2 propanol, although the mixtures are constant boiling, to within 0.6° C., in the region of 3 to 45 weight percent 2-propanol. A minimum boiling azeotrope is thus shown to exist in this composition range.

EXAMPLE 6

Example 2 was repeated except that 2-methyl-2-propanol was used instead of methanol. 2.5 milliliters of HFC-52-13, prepared according to Example 1 above, were initially added to the ebulliometer. The boiling point was measured and corrected to 760 mm Hg (101 kPa), for various mixtures of HFC-52-13 and 2-methyl-2 propanol. Interpolation of these data shows that a minimum boiling point occurs in the region of about 4 to about 23 weight percent 2-methyl-2-propanol. The best estimate of the position of the minimum is 14.2 weight percent 2-methyl 2-propanol, although the mixtures are constant boiling, to within 0.6° C., in the region of 1.4 to 30 weight percent 2-methyl-2-propanol. A minimum boiling azeotrope is thus shown to exist in this composition range.

EXAMPLE 7

Example 2 was repeated except that 2-methyl-2-butanol was used instead of methanol. 2.5 milliliters of HFC-52-13, prepared according to Example 1 above, were initially added to the ebulliometer. The boiling point was measured and corrected to 760 mm Hg (101 kPa), for various mixtures of HFC-52-13 and 2-methyl-2-butanol. Interpolation of these data shows that a minimum boiling point occurs in the region of about 0.05 to about 3.5 weight percent 2-methyl 2-butanol. The best estimate of the position of the minimum is 0.5 weight percent 2-methyl-2-butanol, although the mixtures are constant-boiling, to within 0.6° C., in the region of 0.01 to 5 weight percent 2.methyl-2-butanol. A minimum boiling azeotrope is thus shown to exist in this composition range.

EXAMPLE 8

Example 2 was repeated except that n-hexane was used instead of methanol. 2.5 milliliters of HFC-52-13, prepared according to Example 1 above, were initially charged to the ebulliometer. The boiling point was measured and corrected to 760 mm Hg (101kPa), for various mixtures of HFC-52-13 and n-hexane. Interpolation of these data shows that a minimum boiling point occurs in the region of about 12 to about 33 weight percent n-hexane. The best estimate of the position of the minimum is 22.3 weight percent n hexane, although the mixtures are constant-boiling, to within 0.6° C., in the region of 7 to 40 weight percent n-hexane. A minimum boiling azeotrope is thus shown to exist in this composition range.

EXAMPLE 9

Example 2 was repeated except that isohexane was used instead of methanol. 2.5 milliliters of isohexane were initially charged to the ebulliometer. The boiling point was measured and corrected to 760 mm Hg (101 kPa), for various mixtures of HFC-52-13, prepared according to Example 1 above, and isohexane. Interpolation of these data shows that a minimum boiling point occurs in the region of about 33 to about weight percent isohexane. The best estimate of the position of the minimum is 45.9 weight percent isohexane, although the mixtures are constant boiling, to within 1° C., in the region of 25 to 75 weight percent isohexane. A minimum boiling azeotrope is thus shown to exist in this composition range.

EXAMPLE 10

Example 2 was repeated except that 2-propanone was used instead of methanol. 2.5 milliliters of 2-propanone were initially charged to the ebulliometer. The boiling point was measured and corrected to 760 mm Hg (101 kPa), for various mixtures of HFC-52-13, prepared according to Example 1 above, and 2-propanone. Interpolation of these data shows that a minimum boiling point occurs in the region of about 30 to about 59.6 weight percent 2 propanone. The best estimate of the position of the minimum is 73.8 weight percent 2 propanone, although the mixtures are constant boiling, to within 1° C., in the region of 19 to 85 weight percent 2-propanone. A minimum boiling azeotrope is thus shown to exist in this composition range.

EXAMPLE 11

Example 2 was repeated except that 2-butanone was used instead of methanol. 2.5 milliliters of HFC-52-13, prepared according to Example 1 above, were initially charged to the ebulliometer. The boiling point was measured and corrected to 760 mm Hg (101 kPa), for various mixtures of HFC-52-13 and 2-butanone. Interpolation of these data shows that a minimum boiling point occurs in the region of about 10 to about 35.4 weight percent 2-butanone. The best estimate of the position of the minimum is 15 weight percent 2 butanone, although the mixtures are constant boiling, to within 1° C., in the region of 5 to 41 weight percent 2-butanone. A minimum boiling azeotrope is thus shown to exist in this composition range.

COMPARATIVES A-D AND EXAMPLES 12-14

Performance studies were conducted wherein metal coupons were cleaned using the present azeotrope-like compositions as solvents. The metal coupons were soiled with various types of oils and heated to 93° C. so as to partially simulate the temperature attained while machining and grinding in the presence of these oils.

The metal coupons thus treated were degreased in a three-sump vapor phase degreaser machine. In this typical three-sump degreaser, condenser coils around the lip of the machine were used to condense the solvent vapor which was then collected in a sump. The condensate overflowed into cascading sumps and eventually went into the boiling sump.

The metal coupons were held in the solvent vapor and then vapor rinsed for a period of 15 seconds to 2 minutes depending upon the oils selected. Cleanliness testing of the coupons was done by measurement of the weight change of the coupons using an analytical balance to determine the total residual materials left after cleaning.

CFC-113 was used for Comparatives A and C. HFC-52-13 alone was used for Comparatives B and D. The composition of Example 3 above was used for Example 12. The composition of Example 10 above was used for Example 13. The composition of Example 9 above was used for Example 14. The results are in Table XI.

TABLE XI

| CYCLE | OIL | COMPARATIVE OR EXAMPLE | % OIL REMOVED |
|---|---|---|---|
| Vapor Only | Light Mineral Oil | A | 86.7 |
| Vapor Only | Light Mineral Oil | B | 7.8 |
| Boil Immersion | Light Mineral Oil | C | 99.2 |

TABLE XI-continued

| CYCLE | OIL | COMPARATIVE OR EXAMPLE | % OIL REMOVED |
|---|---|---|---|
| Boil Immersion | Light Mineral Oil | D | 12.9 |
| Boil Immersion | Light Mineral Oil | 12 | 88.3 |
| Boil Immersion | Light Mineral Oil | 13 | 80.6 |
| Boil Immersion | Light Mineral Oil | 14 | 91.0 |

Inhibitors may be added to the present azeotrope-like compositions to inhibit decomposition of the compositions; react with undesirable decomposition products of the compositions; and/or prevent corrosion of metal surfaces. Any or all of the following classes of inhibitors may be employed in the invention: alkanols having 4 to 7 carbon atoms, nitroalkanes having 2 to 3 carbon atoms, 1,2-epoxyalkanes having 2 to 7 carbon atoms, phosphite esters having 12 to 30 carbon atoms, ethers having 3 or 4 carbon atoms, unsaturated compounds having 4 to 6 carbon atoms, acetals having 4 to 7 carbon atoms, ketones having 3 to 5 carbon atoms, and amines having 6 to 8 carbon atoms. Other suitable inhibitors will readily occur to those skilled in the art.

The inhibitors may be used alone or in mixtures thereof in any proportions. Typically, up to about 2 percent based on the total weight of the azeotrope-like composition of inhibitor might be used.

When the present azeotrope-like compositions are used to clean solid surfaces by spraying the surfaces with the compositions, preferably, the azeotrope-like compositions are sprayed onto the surfaces by using a propellant. Preferably, the propellant is selected from the group consisting of hydrocarbons, chlorofluorocarbons, hydrochlorofluorocarbon, hydrofluorocarbon, dimethyl ether, carbon dioxide, nitrogen, nitrous oxide, methylene oxide, air, and mixtures thereof.

Having described the invention in detail and by reference to preferred embodiments thereof, it will be apparent that modifications and variations are possible without departing from the scope of the invention defined in the appended claims.

What is claimed is:

1. Azeotrope-like compositions consisting essentially of from about 47.8 to about 95.2 percent 4-trifluoromethyl-1,1,1,2,2,3,3,5,5,5-decafluoropentane, from about 4.8 to 52.2 weight percent methanol, and from about 0 to about 1 weight percent nitromethane wherein said compositions boil to about 51° C. at 760 mm Hg; or from about 54 to about 96.2 weight percent 4-trifluoromethyl-1,1,1,2,2,3,3,5,5,5-decafluoropentane, from about 3.8 to about 46 weight percent ethanol, and from about 0 to about 1 weight percent nitromethane wherein said compositions boil at about 54.9° C. at 760 mm Hg; or from about 75 to about 99.95 weight percent 4-trifluoromethyl-1,1,1,2,2,3,3,5,5,5-decafluoropentane, from about 0.05 to about 25 weight percent 1-propanol, and from about 0 to about 1 weight percent nitromethane wherein said compositions boil at about 57.7° C. at 760 mm Hg; or from about 54 to about 97 weight percent 4-trifluoromethyl-1,1,1,2,2,3,3,5,5,5-decafluoropentane, from about 3 to about 46 weight percent 2-propanol, and from about 0 to about 1 weight percent nitromethane wherein said compositions boil at about 57.7 C. at 760 mm Hg; or from about 69 to about 98.6 weight percent 4-trifluoromethyl-1,1,1,2,2,3,3,5,5,5-decafluoropentane, from about 1.4 to about 31 weight percent 2-methyl-2-propanol, and from about 0 to about 1 weight percent nitromethane wherein said compositions boil at about 60.1° C. at 760 mm Hg; or from about 94 to about 99.99 weight percent 4-trifluoromethyl-1,1,1,2,2,3,3,5,5,5-decafluoropentane, from about 0.01 to about 6 weight percent 2-methyl-2-butanol, and from about 0 to about 1 weight percent nitromethane wherein said compositions boil at about 61.5° C. at 760 mm Hg; or from about 59 to about 93 weight percent 4-trifluoromethyl-1,1,1,2,2,3,3,5,5,5-decafluoropentane, from about 7 to about 41 weight percent n-hexane, and from about 0 to about 1 weight percent nitromethane wherein said compositions boil at about 51° C. at 760 mm Hg; or from about 24 to about 75 weight percent 4-trifluoromethyl-1,1,1,2,2,3,3,5,5,5-decafluoropentane, from about 25 to about 76 weight percent isohexane, and from about 0 to about 1 weight percent nitromethane wherein said isohexane consists essentially of about 35 to about 75 weight percent 2-methylpentane, about 10 to about 40 weight percent 3-methylpentane, about 7 to about 30 weight percent 2,3-dimethylbutane, about 7 to about 30 weight percent 2,2-dimethylbutane, and about 0.1 to about 10 weight percent n-hexane and said compositions boil at about 46.09° C. at 760 mm Hg; or from about 15 to about 80 weight percent 4-trifluoromethyl-1,1,1,2,2,3,3,5,5,5-decafluoropentane, from about 20 to about 85 weight percent 2-propanone, and from about 0 to about 1 weight percent nitromethane wherein said compositions boil at about 53.8° C. at 760 mm Hg; or from about 59 to about 95 weight percent 4-trifluoromethyl-1,1,1,2,2,3,3,5,5,5-decafluoropentane, from about 5 to about 41 weight percent 2-butanone, and from about 0 to about 1 weight percent nitromethane wherein said compositions boil at about 59.2° C. at 760 mm Hg.

2. The azeotrope-like compositions of claim 1 consisting essentially of from about 54.5 to about 91.5 weight percent said 4-trifluoromethyl-1,1,1,2,2,3,3,5,5,5-decafluoropentane, from about 8.5 to about 45.5 weight percent said methanol, and from about 0 to about 0.5 weight percent said nitromethane.

3. The azeotrope-like compositions of claim 1 consisting essentially of from about 64.5 to about 92.1 weight percent said 4-trifluoromethyl-1,1,1,2,2,3,3,5,5,5-decafluoropentane, from about 7.9 to about 35.5 weight percent said ethanol, and from about 0 to about 0.5 weight percent said nitromethane.

4. The azeotrope-like compositions of claim 1 consisting essentially of from about 80 to about 99.95 weight percent said 4-trifluoromethyl-1,1,1,2,2,3,3,5,5,5-decafluoropentane, from about 0.05 to about 20 weight percent said 1-propanol, and from about 0 to about 0.5 weight percent said nitromethane.

5. The azeotrope-like compositions of claim 1 consisting essentially of from about 57.5 to about 96 weight percent said 4-trifluoromethyl-1,1,1,2,2,3,3,5,5,5-decafluoropentane, from about 4 to about 42.5 weight percent said 2-propanol, and from about 0 to about 0.5 weight percent said nitromethane.

6. The azeotrope-like compositions of claim 1 consisting essentially of from about 74.5 to about 96.5 weight percent said 4-trifluoromethyl-1,1,1,2,2,3,3,5,5,5-decafluoropentane, from about 3.5 to about 25.5 weight percent said 2-methyl-2-propanol, and from about 0 to about 0.5 weight percent said nitromethan.

7. The azeotrope-like compositions of claim 1 consisting essentially of from about 95.5 to about 99.95 weight percent said 4-trifluoromethyl-1,1,1,2,2,3,3,5,5,5-decafluoropentane, from about 0.05 to about 4.5 weight percent said 2-methyl-2-butanol, and from about 0 to about 0.5 weight percent said nitromethan.

8. The azeotrope-like compositions of claim 1 consisting essentially of from about 64.6 to about 90 weight percent said 4-trifluoromethyl-1,1,1,2,2,3,3,5,5,5-decafluoropentane, from about 10 to about 35.4 weight percent said n-hexane, and from about 0 to about 0.4 weight percent said nitromethane.

9. The azeotrope-like compositions of claim 1 consisting essentially of from about 39.5 to about 70 weight percent said 4-trifluoromethyl-1,1,1,2,2,3,3,5,5,5-decafluoropentane, from about 30 to about 60.5 weight percent said isohexane, and from about 0 to about 0.5 weight percent said nitromethane.

10. The azeotrope-like compositions of claim 1 consisting essentially of from about 18 to about 65 weight percent said 4-trifluoromethyl-1,1,1,2,2,3,3,5,5,5-decafluoropentane, from about 35 to about 32 weight percent said 2-propanone, and from about 0 to about 0.5 weight percent said nitromethane.

11. The zeotrope-like compositions of claim 1 consisting essentially of from about 61.5 to about 92.5 weight percent said 4-trifluoromethyl-1,1,1,2,2,3,3,5,5,5-decafluoropentane, from about 7.5 to about 38.5 weight percent said 2-butanone, and from about 0 to about 0.5 weight percent said nitromethane.

12. The azeotrope-like compositions of claim 1 wherein an effective amount of an inhibjtor selected from the group consisting of alkanols having 4 to 7 carbon atoms, nitroalkanes having 2 to 3 carbon atoms, 1,2-epoxyalkanes having 2 to 7 carbon atoms, phosphite esters having 12 to 30 carbon atoms, acetals having 4 to 7 carbon atoms ketones having 3 to 5 carbon atoms, and amines having 6 to 8 carbon atoms is present.

13. The azeotrope-like compositions of claim 2 wherein an effective amount of an inhibitor selected from the group consisting of alkanois having 4 to 7 carbon atoms, nitroalkanes having 2 to 3 carbon atoms, 1,2-epoxyalkanes having 2 to 7 carbon atoms, phosphite esters having 12 to 30 carbon atoms. acetals having 4 to 7 carbon atoms, ketones having 3 to 5 carbon atoms, and amines having 6 to 8 carbon atoms at present.

14. The azeotrope-like compositions of claim 3 wherein an effective amount of an inhibitor selected from the group consisting of alkanols having 4 to 7 carbon atoms, nitroalkanes having 2 to 3 carbon atoms, 1,2 -epoxyalkanes having 2 to 7 carbon atoms, phosphite esters having 12 to 30 carbon atoms, acetals having 4 to 7 carbon atoms, ketones having 3 to 5 carbon atoms, and amines having 6 to 8 carbon atoms is present.

15. The azeotrope-like compositions of claim 4 wherein an effective amount of an inhibitor selected from the group consisting of alkanols having 4 to 7 carbon atoms, nitroalkanes having 2 to 3 carbon atoms, 1,2-epoxyalkanes having 2 to 7 carbon atoms, phosphite esters having 12 to 30 carbon atoms, acetals having 4 to 7 carbon atoms, ketones having 3 to 5 carbon atoms, and amines having 6 to 8 carbon atoms is present.

16. The azeotrope-like compositions of claim 5 wherein an effective amount of an inhibitor selected from the group consisting of alkanois having 4 to 7 carbon atoms, nitroalkanes having 2 to 3 carbon atoms, 1,2-epoxyalkanes having 2 to 7 carbon atoms, phosphite esters having 12 to 30 carbon atoms, acetals having 4 to 7 carbon atoms, ketones having 3 to 5 carbon atoms, and amines having 6 to 8 carbon atoms is present.

17. A method of dissolving contaminants or removing contaminants from the surface of a substrate which comprises the step of: treating said surface of said substrate with said azeotrope-like composition of claim 1 as solvent.

18. A method of dissolving contaminants or removing contaminants from the surface of a substrate which comprises the step of:

treating said surface of said substrate with said azeotrope-like composition of claim 2 as solvent.

19. A method of dissolving contaminants or removing contaminants from the surface of a substrate which comprises the step of:

treating said surface of said substrate with said azeotrope-like composition of claim 3 as solvent.

20. A method of dissolving contaminants or removing contaminants from the surface of a substrate which comprises the step of:

treating said surface of said substrate with said azeotrope-like composition of claim 4 as solvent.

* * * * *